US006336556B1

(12) United States Patent
Gale

(10) Patent No.: US 6,336,556 B1
(45) Date of Patent: Jan. 8, 2002

(54) UNITARY MULTI-CELL PARTITION AND CARTON OR TRAY CONTAINING THE SAME AND METHOD

(75) Inventor: Gregory W. Gale, Napa, CA (US)

(73) Assignee: Regale Corporation, Napa, CA (US)

( * ) Notice: Subject to any disclaimer, the term of this patent is extended or adjusted under 35 U.S.C. 154(b) by 0 days.

(21) Appl. No.: 09/539,160

(22) Filed: Mar. 29, 2000

(51) Int. Cl.[7] ..... B65D 75/00; B65D 25/04

(52) U.S. Cl. ..... 206/427; 206/426; 206/193; 220/510; 220/516; 220/528

(58) Field of Search ..... 206/427, 433, 206/426, 193; 220/510, 528, 529, 516

(56) References Cited

U.S. PATENT DOCUMENTS 2,580,043 A * 12/1951 Paige ..... 206/426
3,752,385 A * 8/1973 Woodgate ..... 220/510 X
4,326,629 A * 4/1982 Tate ..... 206/427 X
4,635,810 A * 1/1987 Tate ..... 220/510
5,071,026 A * 12/1991 Apps ..... 220/516
5,402,890 A * 4/1995 Yajima et al. ..... 206/565 X
5,975,300 A * 11/1999 Gale ..... 206/433

* cited by examiner

*Primary Examiner*—Bryon P. Gehman
(74) *Attorney, Agent, or Firm*—Flehr Hohbach Test Albritton & Herbert LLP

(57) ABSTRACT

A unitary multi-cell partition for packaging articles for use with a multi-sided carton or tray having a circumscribed space therein. The partition is formed of molded pulp and is capable of being disposed in the space and is adapted to receive the articles within the cells of the partition. The partition comprises a plurality of wall portions which are inclined from the vertical when the partition is free standing and free of the space in the carton or tray. The plurality of wall portions are arranged to provide a plurality of vertically disposed spaced-apart cells. The wall portions have upper and lower extremities and hinge portions joining certain of said upper extremities of the wall portions and joining certain of the lower extremities of the wall portions to permit bending of certain of the wall portions with respect to other of the wall portions. The wall portions of the partition form a partition which has dimensions which are greater than the space in the carton or tray whereby the partition must be compressed into a smaller size to fit within space in the carton or tray.

24 Claims, 5 Drawing Sheets

UNITARY MULTI-CELL PARTITION AND CARTON OR TRAY CONTAINING THE SAME AND METHOD

This invention relates to a unitary multi-cell partition and a carton or tray containing the same and method and more particularly to a unitary multi-cell partition formed of molded pulp.

Partitions have heretofore been provided for use in cartons. However, typically such partitions have been of a multi-piece construction which has a number of undesirable features. For example, such a multi-piece construction is difficult to assemble, particularly when machinery is utilized for packaging. In addition, the use of multi-piece construction increases packaging costs. There is therefore a need for a new and improved partition construction for use with cartons.

In general, it is an object of the present invention to provide a unitary multi-cell partition and a carton containing the same and a method.

Another object of the invention is to provide a partition of the above character which can be formed of molded fibers.

Another object of the invention is to provide a partition and method of the above character which can utilize existing carton packing and unpacking equipment.

Another object of the invention is to provide a partition of the above character in which integral corrugations can be provided in the partitions to simulate partition thicknesses of existing multiple-piece slotted partitions to thereby permit use of presently manufactured corrugated outer cartons.

Another object of the invention is to provide a partition of the above character having panel or sidewall partitions in which cutouts are provided in the tops of each panel portion to minimize the opportunity for glassware or other articles being loaded into a carton catching onto the panel or side wall portions and also to prevent snagging of leading edges of any labels on the glassware or labels.

Another object of the invention is to provide a partition of the above character which facilitates robotic placement of glassware or other articles into the cells of the unitary partition while minimizing false scoring of the panel portions.

Another object of the invention is to provide a partition of the above character that forms a friction fit with the carton.

Another object of the invention is to provide a partition of the above character which can be economically manufactured.

Another object of the invention is to provide a partition of the above character which is environmentally desirable because of its use of molded pulp.

Additional objects and features of the invention will appear from the following description in which the preferred embodiments are set forth in detail in conjunction with the accompanying drawings.

Figure 1:
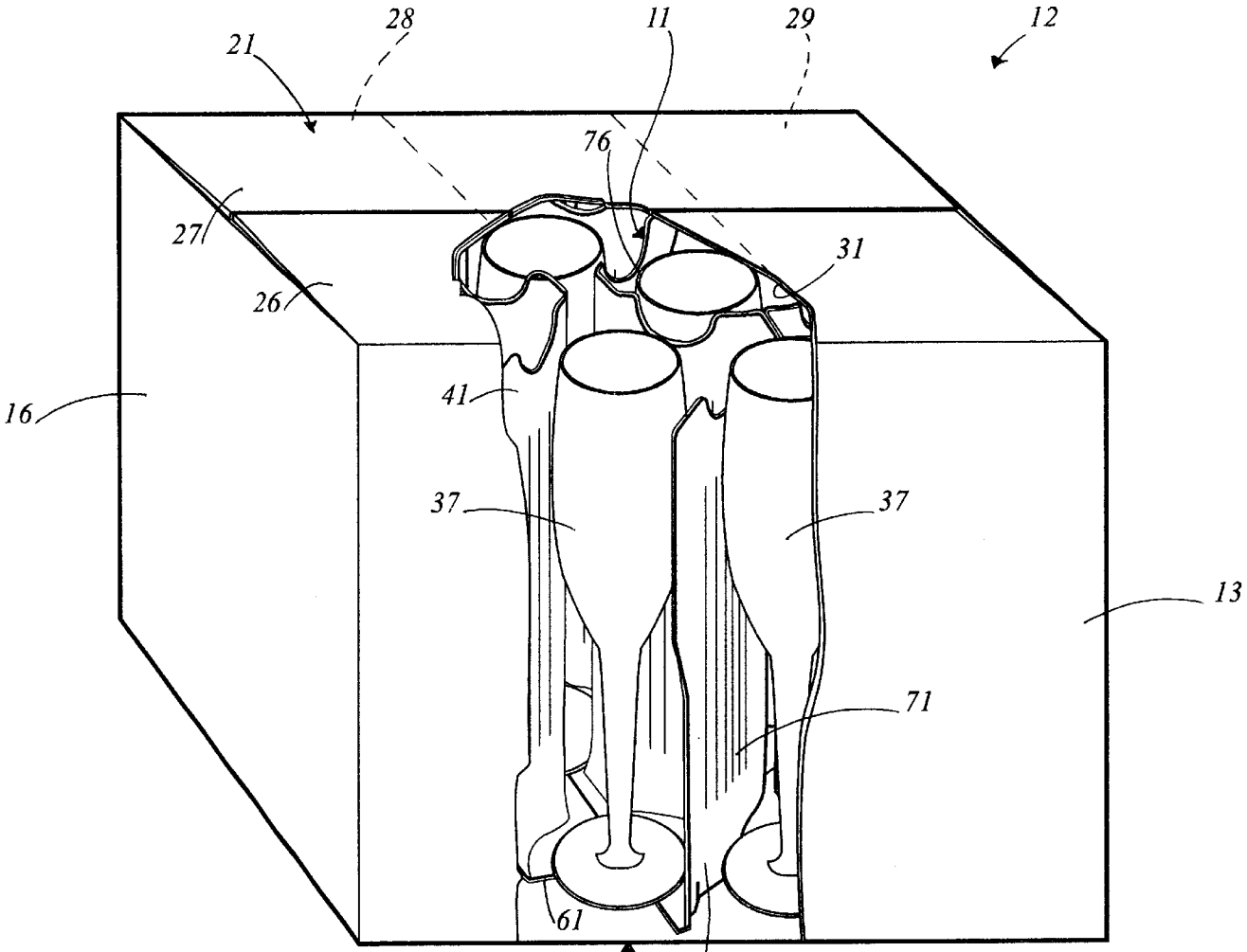
FIG. 1 is an isometric view of a carton with certain portions broken away showing therein a unitary multi-cell partition incorporating the present invention and having articles carried therein.

In general, the unitary multi-cell partition is for use with a multi-sided carton or tray having interior walls. The partition is adapted to be compressed to fit within and frictionally engage the interior walls of the carton or tray. The partition is comprised of side wall portions which are inclined from the vertical when the partition is free of the carton that have a draft angle which is greater than 5°. The wall portions form a plurality of vertically disposed spaced-apart cells. The wall portions forming each cell are split into two sections along a linear or a diagonal axis. The partition has hinge portions joining certain of said wall portions permitting bending of the wall portions forming the cells toward and away from each other, thereby facilitating separation of the partition from the mold and insertion into the carton. Certain of the hinge portions are formed by bottom wall portions adjoining the wall portions.

More in particular as shown in FIGS. 1 through 5 of the drawings, the unitary multi-cell partition 11 is for use in a conventional six-sided carton or tray 12 having interior walls. Such a six-sided carton 12 typically is formed of corrugated paper often called cardboard and consists of spaced-apart parallel side walls 13 and spaced-apart parallel end walls 16 adjoining the side walls 13 at right angles thereto. The top and bottom sides are enclosed by a top closure and bottom closure 21. Both of the top and bottom closures 21 are formed by major flaps 26 and 27 adjoining the side walls 13 and minor flaps 28 and 29 adjoining the end walls 16 with typically the minor flaps 28 and 29 being folded inwardly first and then overlaid by the major flaps 26 and 27. The minor flaps and the major flaps can be fastened together by a suitable means such as an adhesive or staples (not shown) for adhering the major flaps 26 and 27 to the minor flaps 28 and 29 to provide within the carton 12 a circumscribed space 31 which is enclosed with the six-sided carton 12. The carton 12 with its circumscribed space 31 is adapted to receive the unitary multi-cell partition 11 with or without the articles to be packaged. The tray (not shown) can be in the form of a carton 12 having an open top with the side walls 13 and the end walls 16 of the desired height and a bottom closure 21.

The unitary multi-cell partition 11 is formed of a molded pulp which also can be characterized as molded fiber. The molded pulp or fiber typically can be obtained from recycled newspapers, telephone books, cardboard, corrugated cardboard boxes and even from short fibers from wood pulp which are unsuitable for making paper. Such molded partitions can also be recycled and formed into molded pulp and reutilized for the same purpose.

Figure 2:
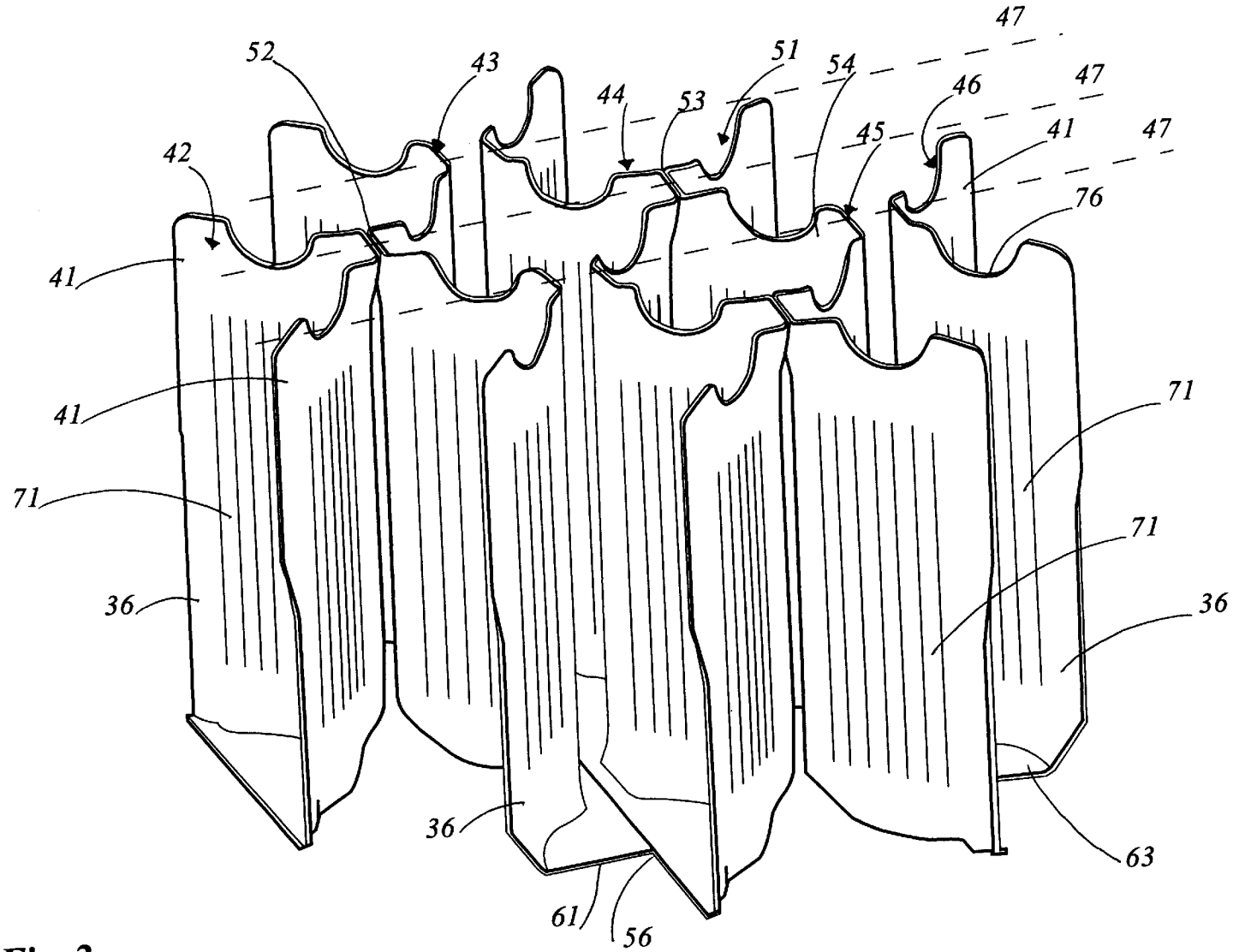
FIG. 2 is an isometric view of the unitary multi-cell partition when outside of the carton showing it splayed apart in its free condition.
Figure 3:
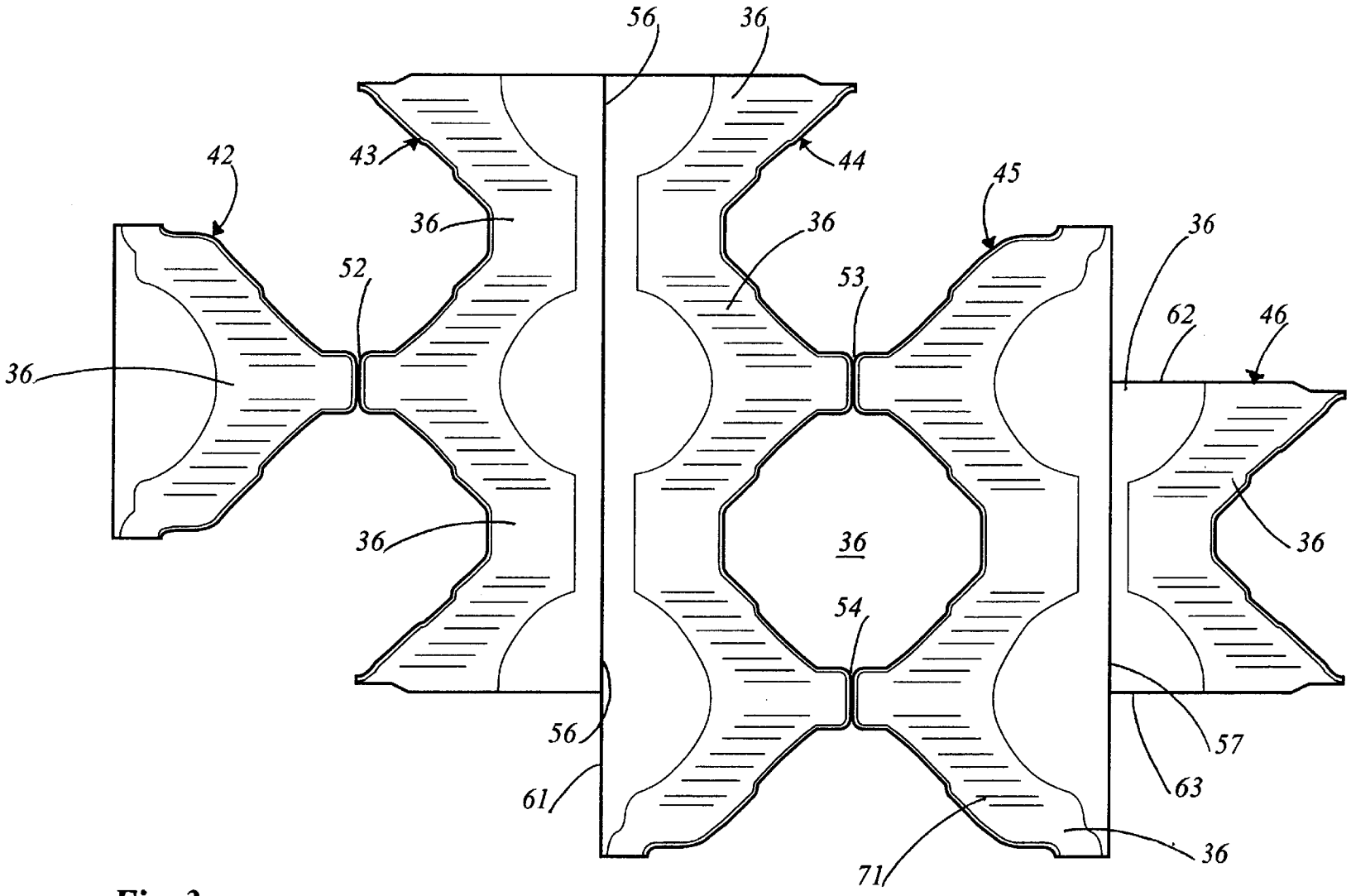
FIG. 3 is a top plan view of the partition shown in FIG. 2.
Figure 4:
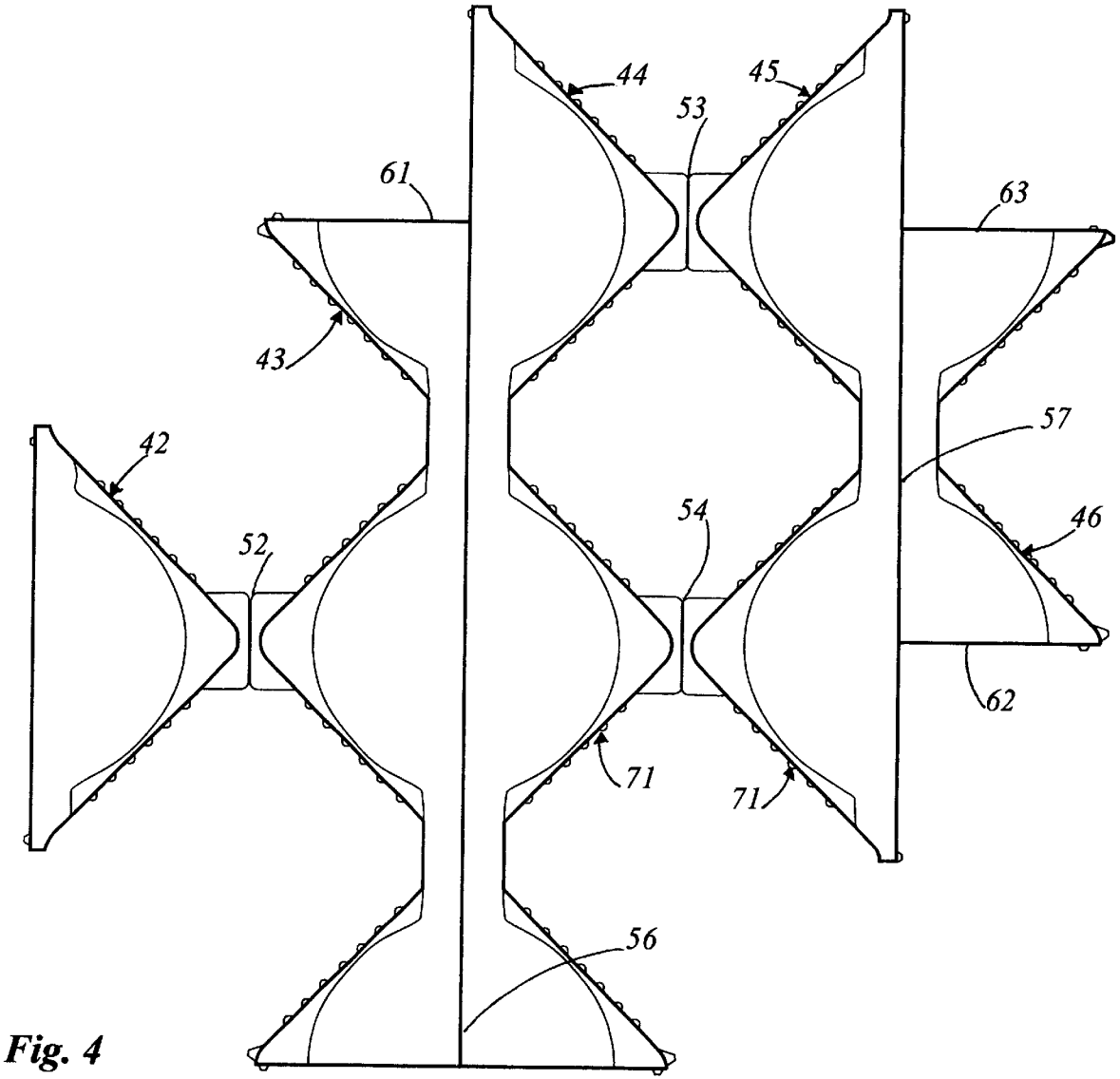
FIG. 4 is a bottom plan view of the partition shown in FIG. 2.
Figure 5:
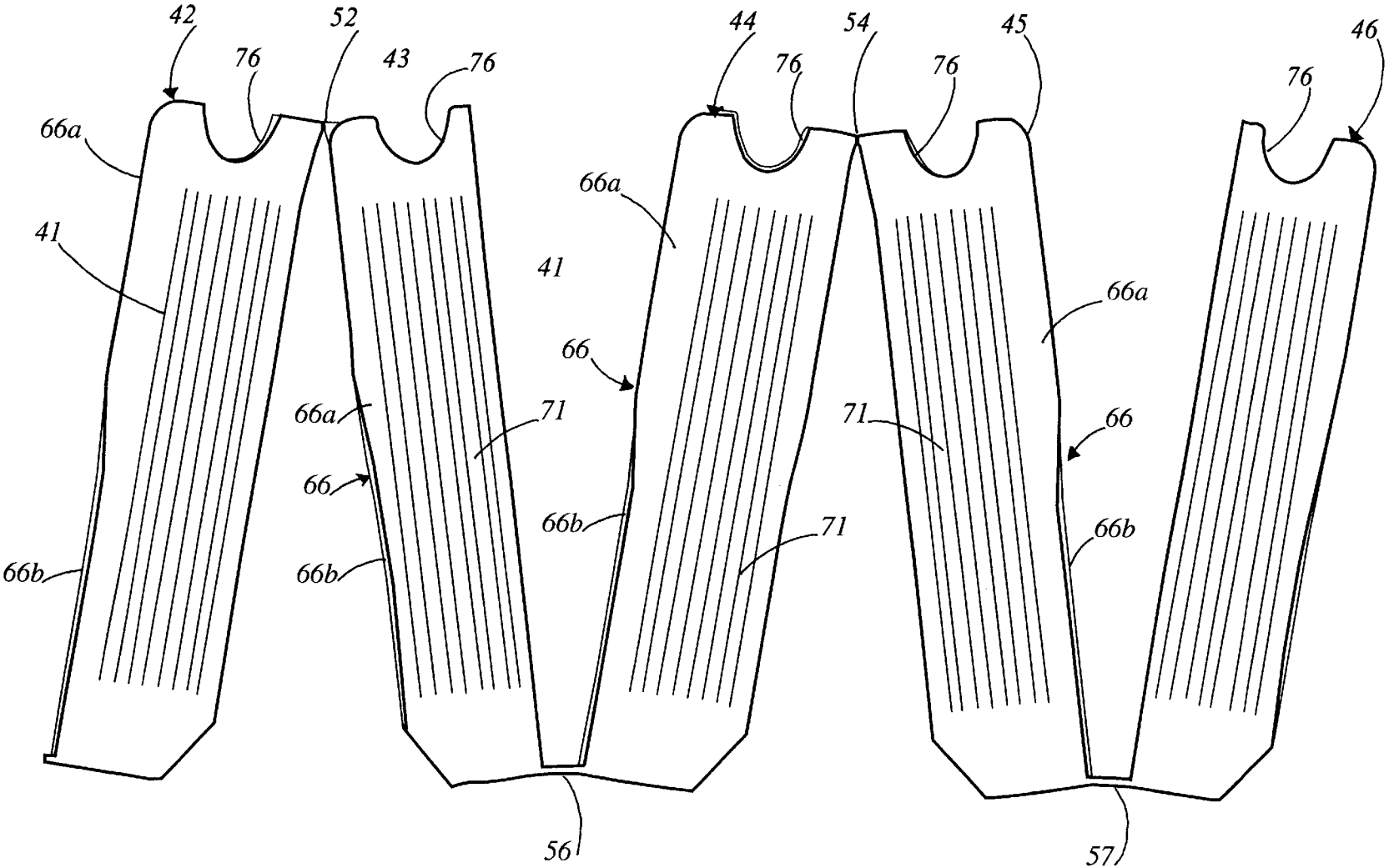
FIG. 5 is a side elevational view of the partition shown in FIG. 2.

The unitary multi-cell partition 11 as shown in FIG. 2 is the expanded or splayed apart position provided by the mold and before compression of the same to fit within the interior or enclosed space 31 in the carton 12. As shown, the partition 11 is formed in one piece and is provided with a plurality of cells 36 which are shaped to receive the articles to be packaged as for example glassware such as the stemmed glasses 37 as shown within the cells 36 in FIG. 1.

The partition 11 is provided with a plurality of wall portions or panels 41 which typically are adapted to extend in a vertical direction when the partition 11 is disposed in the space 31 in the carton 12. When the partition 11 is free and outside of the carton 12, the wall partitions 41 are inclined at an angle from the vertical as for example at an angle from 5–10° but typically at an angle of 8° to provide a sufficient draft so that the partition can be readily separated from the mold after it has been formed. As shown, the wall portions or panels 41 are arranged to provide a plurality of the cells 36 as for example three rows of four cells each to provide a total of twelve cells in the embodiment shown in FIGS. 1 through 5 of the drawings. It should be appreciated that in accordance with the present invention, different numbers of cells can be provided as for example four cells, eight cells, twelve cells, twenty-four cells and even thirty-six cells if desired.

In the arrangement shown in FIGS. 1 through 5, the unitary molded cell partition 11 is splayed apart in five wall sections 42, 43, 44, 45 and 46 along lines which are generally perpendicular to an imaginary line extending diagonally across the partition 11.

The partition is provided with a plurality of hinge portions 51 hereinafter described more in detail which adjoin certain of said wall sections to permit bending of the wall sections forming the cells 36 towards and away from each other and facilitating the separation of the partition from the mold after manufacture and insertion into the space 31 in the carton 12. These hinge portions 51 are molded of the same molded pulp or fiber as the wall portions or panels 41. Thus there has been provided a hinge portion 52 adjoining the wall sections 42 and 43 which hinge portion is elongate and extends in a direction generally perpendicular to a plurality of parallel spaced apart imaginary lines 47 (see FIG. 2). Similarly there are provided hinge portions 53 and 54 which are used for joining sections 44 and 45 both of which also extend substantially perpendicular to the imaginary lines 47. An additional hinge portion 56 is provided which also serves as a bottom wall portion serving to join the bottom extremities of wall sections 43 and 44. Similarly another hinge portion 57 is provided also serving as a bottom wall portion joining the lower extremities of the sections 45 and 46. A single triangularly-shaped cutout 61 is provided in the hinge portion 56 whereas first and second triangularly-shaped cutouts 62 and 63 are provided in the hinge portion 57. These cutouts are provided to save material where it is not needed.

By utilizing molded partitions, it is possible to eliminate what has been termed "false scoring". Typically when utilizing corrugated cardboard it has been necessary to place a score on the board in order to fold it, as for example to provide a score to fold a flap. In existing partition systems heretofore utilized, it has been necessary to cut out slots in the partitions to permit them to slide together. The remaining material below these cutouts tends to get a false score, thereby permitting the partition to bend slightly and invade an adjacent space so that one cell is oversized and the adjacent one is undersized, creating problems when utilizing robotics in packaging articles as for example glassware. When glassware enters that space where the partition has invaded the space, the partition will be sheared upon entry of the glass or the glass will break or bounce up. With the molded partitions of the present invention, such false scoring cannot occur and the multiple cells which have been formed maintain their consistency in size. The inclined portions provided on the free side edges of the wall portions also serve to maintain the uniformity of the cells formed by inhibiting movement of the wall portions with respect to the interior surfaces of the side and end walls of the carton.

The free side edges 66 of the wall sections 42–46 have upper and lower portions 66*a* and 66*b* respectively which are molded at inclined opposite angles with respect to each other. Thus as shown, the portions 66*a* and 66*b* have been inclined by an angle of approximately 45° with respect to the plane of the wall portion 41 of which it forms a part so that the included angle between the two portions is approximately 90°. Different angles may be utilized for the portions 66*a* and 66*b*, as for example angles ranging from 30° to 55°, to provide an included angle for both portions ranging from 60° to 110° with the preferable angle being the 45° angle hereinbefore mentioned. These angle portions 66*a* and 66*b* as hereinafter described are provided to frictionally engage the interior surfaces of the side and end walls of the carton 12 when the partition 11 is disposed within the carton so that each wall portion 41 firmly frictionally engages the wall of the carton and inhibits movement of the wall portion 41 in either direction with respect to the wall of the carton in a direction generally perpendicular to the plane of the wall portion 41.

As shown in the drawings, it may be desirable to place spaced-apart parallel vertically disposed corrugations 71 in the wall portions 41 to provide fluting which reinforces and strengthens the wall portion as well as the overall strength of the partition 11. In addition, these corrugations or flutings 71 can be utilized to accommodate varying thicknesses of multi-piece paperboard partitions heretofore utilized in cartons so that the existing corrugated cartons heretofore utilized can be used for packing the articles typically packaged in such cartons. In this way, it is possible for the unitary multi-cell partition of the present invention to replicate the thicknesses provided by paperboard partitions heretofore utilized which range in thickness from 0.625" to 0.125". Such differences in thicknesses in the two-piece partitions can be readily accommodated by the unitary multi-cell partition of the present invention merely by providing the corrugations or fluting 71 of various heights.

In other words, by providing the corrugations it is possible to vary the wall thickness of the wall portions without increasing the thickness of the molded material. Thus the corrugations can be utilized to emulate different thicknesses of partitions heretofore utilized, making it possible to continue to utilize the same cartons which have been used for the packing and shipping of articles such as glassware.

In order to inhibit label scuffing, it may be desirable to modify the corrugations 71 shown. For example the two middle corrugations, assuming there are six corrugations 71, the third and fourth corrugations in the middle can be eliminated with the exception that the top portion of those two corrugations can remain. For example, if labeled wine bottles are being packaged, the top one-eighth of these middle corrugations that remains engages the shoulder of the wine bottle but because of its position will not engage the label. Since the wine label is typically on a cylindrical wine bottle, the tangential portion of the wine label engaging the wall portion 41 will engage the wall portion in the vicinity where the central or middle corrugations have been eliminated. Thus in this position even if the wine bottle rotates slightly, the corrugations will still remain out of tangential contact with the wine bottle and the label will not be scuffed.

Semicircular cutouts 76 are then provided in the upper extremities of the wall portions 41 and extend approximately across one-half the width of the wall portion 41. Such semicircular cutouts have been provided to minimize the possibilities of the articles as for example glassware from catching on the wall portions during loading of the glassware into the cells 36 of the unitary multi-cell partition 11. In addition these cutouts serve to prevent snagging of leading edges of any labels or the glassware or articles.

Although the cutouts or scallops 66 hereinbefore described have been described as semicircular, it should be appreciated that they can have different shaped if desired, as for example they can be in the form of an upwardly facing V.

In looking at the cells 36 formed by the unitary multi-cell partition 11, it can be seen that every cell can be considered to be split along a linear axis but on the diagonal. Also with respect to the hinge portions 51 it can be seen that there are provided two types of hinges with hinges 52, 53 and 54 being in the form of top or high short hinges whereas the bottom hinge portions 56 and 57 which are the hinges which have bottom wall portions can be considered to form bottom or low long hinges. Thus with the hinge portions 51 it can be seen that there is provided an alternating pattern when looking from left to right in FIG. 2 that can be considered to be a high hinge, a low hinge, a high hinge, and a low hinge. The hinge portions 56 and 57 which can be considered to be the bottom hinges have more mass than the top hinges 52, 53 and 54 and thus give greater strength and stability to the unitary multi-cell partition.

Operation and use of the unitary multi-cell partition for the packaging of articles such as stemmed glasses 37 may now be briefly described as follows. Let it be assumed that a partition 11 of the type shown in FIG. 2 has been provided. This partition 11 has the unique advantage in that it is a single unitary partition and not a multi-part partition, facilitating its handling manually or by robotic machinery. In preparation for insertion of the partition 11 into the carton 12, the partition can either be grasped manually or robotically by engaging the wall sections 42 and 46 and compressing the same from both sides in directions along the imaginary line 47 and compressing it into a rectangular shape and then inserting it through the top side of the carton 12, assuming that the carton 12 has been erected with the top side open or is without a top such as with a tray and the bottom closure in place. Thereafter or at the same time, the articles such as the stemmed glasses 37 to be packaged can be lowered into the cells 36. As soon as the partition 11 is released, it will expand outwardly until the free side edges 66 of the wall portions 47 engage the side walls and end walls of the carton to frictionally retain the wall portions 47 of the partition 11 in engagement with the side and end walls of the carton 12 to inhibit movement along the walls and to thereby maintain substantially uniform cell sizes for the cells 36 in the partition 11. In addition, the glassware 37 or other articles form a friction fit with the partition to prevent unintentional disengagement of the partition from the carton 12.

As hereinbefore explained, the cutouts 76 minimizes the chances of the articles as for example glassware bases from catching on the wall portions 41. Similarly, by removing the central or middle corrugations of the corrugations 71, label scuffing can be avoided.

Thus it can be seen that cartons with the unitary multi-cell partition of the present invention therein can be utilized for safely shipping articles such as glassware from one location to another. When it is desired to open a carton and remove the articles as for example glassware from the carton, the glassware can be readily removed by removing the glassware piece or piece or alternatively by removing the unitary partition from the carton and thereafter removing the glasses.

From the foregoing it can be seen that there has been provided a new and improved unitary multi-cell partition which can be utilized with existing case packing and unpacking equipment. Existing cartons and spacing typically provided by partition systems heretofore utilized can be readily emulated. Catching of articles during loading into the unitary partition has been minimized or eliminated. Label scuffing and false scoring also has been minimized.

What is claimed:

1. A unitary multi-cell partition for receiving articles for use with a multi-sided carton or tray having spaced-apart parallel side walls and spaced-apart parallel end walls extending at right angles to the spaced parallel side walls and a bottom wall adjoining the side walls and end walls to provide m a circumscribed space extending vertically from the bottom wall, the unitary partition being formed of molded pulp and being capable of being disposed in the space and being adapted to receive the articles within the cells of the partition, the partition comprising a plurality of wall portions which are inclined from the vertical when the partition is free, said wall portions being inclined at a draft angle ranging from 2° to 10°, said plurality of wall portions being arranged to provide a plurality of vertically disposed spaced-apart cells, said wall portions having upper and lower extremities and hinge portions joining certain of said upper extremities of the wall portions and joining certain of the lower extremities of the wall portions to permit bending of certain of the wall portions with respect to other of the wall portions, the wall portions of the partition forming a partition which has dimensions which are greater than the space between the side and end walls of the carton or tray whereby the partition must be compressed into a smaller size to fit within the space in the carton or tray.

2. A partition as in claim 1 wherein the partition is formed so that it is compressed against a yieldable force whereby when the partition is released in the space in the carton a tray or tray it will expand to cause certain of the wall portions to frictionally engage the side and end walls of the carton to inhibit movement with respect to the side and end walls.

3. A partition as in claim 1 wherein the hinge portions at the lower extremities of the wall portions have bottom wall portions forming a portion thereof.

4. A partition as in claim 1 wherein the upper extremities of the wall portions are provided with cutouts to facilitate loading of articles into the cells.

5. A partition as in claim 4 wherein said cutouts are semicircular.

6. A partition as in claim 1 wherein at least certain of said wall portions have a plurality of parallel spaced-apart corrugations extending from the lower extremity to the upper extremity of each wall portion.

7. A partition as in claim 6 wherein each wall portion has a middle portion and wherein the middle portion is free of said corrugations.

8. A partition as in claim 7 wherein the upper extremity of the wall portion above the middle portion is provided with corrugations.

9. A partition as in claim 1 wherein twelve cells are provided arranged in three first rows of four cells and four second rows of three cells each.

10. A partition as in claim 1 wherein said wall portions are splayed apart in five wall sections along lines perpendicular to imaginary lines extending diagonally across the partition.

11. A partition as in claim 1 wherein certain of said wall portions have free side edges adapted to engage the side and end walls of the carton or tray.

12. A partition as in claim 1 wherein the wall portions provide first, second, third, fourth and fifth wall sections, the first and second wall sections being joined together by a single top hinge, the second and third wall sections being joined by a bottom hinge portion, the third and fourth wall sections being joined by first and second top hinge portions, and the fourth and fifth wall sections being joined together by a bottom hinge portion.

13. A partition as in claim 12 wherein the first hinge portion is provided with a cutout and the second bottom hinge portion is provided with first and second cutouts.

14. A partition as in claim 13 wherein said cutouts in the bottom hinge portions are triangular in shape.

15. A partition as in claim 12 wherein certain of said wall sections have wall portions with free side edges adapted to engage the side walls and end walls of the carton or tray.

16. A partition as in claim 15 wherein said free side edges are formed with angularly extending longitudinal side margins extending at angles ranging from 30 to 110°.

17. A partition as in claim 16 wherein said side margins extend substantially equal distances along the side edges.

18. The combination of a carton or tray and a unitary multi-cell partition therein for use with articles to be packaged, the carton or tray being multi-sided and having spaced-apart parallel side walls and spaced-apart parallel end walls extending at right angles to the spaced-apart parallel side walls and a bottom wall adjoining the side walls and end walls to provide a circumscribed space extending vertically from the bottom wall to the top wall, the unitary partition being formed of molded pulp and being capable of being disposed in said space and being adapted to receive the articles within the cells of the partition, the unitary partition comprising a plurality of wall portions to provide a plurality of vertically disposed spaced-apart cells, said wall portions having upper and lower extremities and hinge portions joining certain of the upper extremities of the wall portions and joining certain of the lower extremities of the wall portions, certain of the wall portions having side edges frictionally engaging the side and end walls of the carton or tray.

19. The combination as in claim 18, the unitary partition being formed so that the side edges of certain of the wall portions are yieldably urged into engagement with the side and end walls of the carton or tray.

20. The combination as in claim 19 wherein said side edges of the unitary partition have longitudinally extending side margins inclined at opposite angles with respect to each other.

21. A method for packaging articles in a multi-sided carton or tray of pulp material having spaced-apart parallel side walls and spaced-apart parallel end walls adjoining the side walls at 90° angles and a bottom wall adjoining the side walls and end walls and forming a circumscribed space, comprising forming a unitary multi-cell partition with adjoined splayed apart wall sections having wall portions forming a plurality of cells with outer dimensions which are greater than the dimensions of the space in the carton or tray, compressing the wall sections together against the yieldable force of the pulp material to a size so that the portions can fit within the space in the carton or tray and releasing the unitary partition and permitting the wall sections to frictionally engage the side and end walls of the carton or tray.

22. A method as in claim 21 further including the step of providing a partition having fee outwardly extending side edges and forming oppositely angled side margins in the side edges to frictionally engage the side and end walls of the carton or tray to inhibit movement in opposite directions of the side edges with respect to the side and end walls of the carton or tray.

23. A method as in claim 21 further including providing spaced-apart parallel corrugations extending from the lower extremities to the upper extremities of the wall portion to strengthen the wall portions.

24. A method as in claim 23 further including the step of forming the corrugations to provide wall portions of a desired thickness to emulate the thickness of an existing partition.

* * * * *